United States Patent [19]

Radler, Jr. et al.

[11] 4,092,161

[45] May 30, 1978

[54] INORGANIC PHOTOCONDUCTORS WITH PHENYL SUBSTITUTED IMAGE TRANSPORT MATERIALS

[75] Inventors: Richard W. Radler, Jr., Penfield; Richard P. Millonzi, Marion; John A. Bergfjord, Macedon, all of N.Y.

[73] Assignee: Xerox Corporation, Stamford, Conn.

[21] Appl. No.: 538,637

[22] Filed: Jan. 6, 1975

Related U.S. Application Data

[63] Continuation of Ser. No. 346,393, Mar. 30, 1973, abandoned, which is a continuation-in-part of Ser. No. 192,898, Oct. 27, 1971, abandoned.

[51] Int. Cl.[2] ..... G03G 5/24

[52] U.S. Cl. ..... 96/1.5 R; 252/501

[58] Field of Search ..... 96/1 R, 1.5, 1.8; 252/501

[56] References Cited

U.S. PATENT DOCUMENTS

| | | | |
|---|---|---|---|
| 3,287,116 | 11/1966 | Hoegl | 96/1.5 |
| 3,418,116 | 12/1968 | Inami et al. | 96/1.5 |
| 3,598,582 | 8/1971 | Herrick et al. | 96/1.5 |
| 3,725,058 | 4/1973 | Hayashi et al. | 96/1.5 |
| 3,870,516 | 3/1975 | Smith et al. | 96/1.5 |
| 3,879,200 | 4/1975 | Regensburger et al. | 96/1.5 |

FOREIGN PATENT DOCUMENTS

| | | | |
|---|---|---|---|
| 4,316,198 | 7/1968 | Japan | 96/1.5 |

*Primary Examiner*—Roland E. Martin, Jr.
*Attorney, Agent, or Firm*—James R. Ralabate; Eugene O. Palazzo; John E. Crowe

[57] ABSTRACT

A photosensitive member having at least two operative materials. The first material comprises a photoconductive material which is capable of photogenerating and injecting photoexcited holes into a contiguous electronically active material. The electronically active material is catalytically synthesized from vinyl derivatives of suitable polycyclic compounds exemplified by phenyl substituted aromatic or heterocyclic groups such as a phenylnaphthalene, a phenylanthracene, a phenylindole, a phenylpyrene and corresponding polymers thereof, the active material being substantially non-absorbing in the wavelength of xerographic use and capable of transporting photogenerated holes. The photoconductive and electronically active materials may be combined in binder or layered xerographic plate configurations.

14 Claims, 10 Drawing Figures

INORGANIC PHOTOCONDUCTORS WITH PHENYL SUBSTITUTED IMAGE TRANSPORT MATERIALS

This application is a continuation of U.S. application Ser. No. 346,393, filed on Mar. 30, 1973, now abandoned, which is, in turn, a continuation-in-part of abandoned U.S. application Ser. No. 192,898, filed on Oct. 27, 1971, and entitled "Photoactive Polymers; Induced Exocyclic Quartet Concept." The invention relates, in general, to xerography and more specifically to a novel photosensitive imaging member and method of imaging.

BACKGROUND OF THE INVENTION

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive insulating layer.

A photoconductive layer for use in xerography may be a homogeneous layer of a single material such as vitreous or it may be a composite layer containing a photoconductor and another material. One type of composite photoconductive layer used in xerography is illustrated by U.S. Pat. No. 3,121,006 to Middleton and Reynolds which describes a number of binder comprising finely-divided particles of a photoconductive compound dispersed in an electrically insulating organic resin binder. In its present commercial form, the binder layer contains particles of zinc oxide uniformly dispersed in a resin binder and is coated on a paper backing.

In particular examples of binder systems described in Middleton et al., the binder comprises a material which is incapable of transporting injected charge carriers generated by the photoconductor particles for any significant distance. As a result, with the particular materials disclosed in the Middleton et al. patent, the photoconductor particles must be in substantially continuous particle-to-particle contact throughout the layer in order to permit the charge dissipation required for cyclic operation. With the uniform dispersion of photoconductor particles described in Middleton et al., therefore, a relatively high volume concentration of photoconductor, up to about 50 percent or more by volume, is usually necessary in order to obtain sufficient photoconductor particle-to-particle contact for rapid discharge. It has been found, however, that high photoconductor loadings in the binder layers of the resin type result in the physical continuity of the resin being destroyed, thereby significantly reducing the mechanical properties of the binder layer. Layers with high photoconductor loadings are often characterized by a brittle binder layer having little or no flexibility. On the other hand, when the photoconductor concentration is reduced appreciably below about 50 percent by volume, the discharge rate is reduced, making high speed cyclic or repeated imaging difficult or impossible.

U.S. Pat. No. 3,121,007 to Middleton et al. teaches another type of photoconductor which includes a two phase photoconductive binder layer comprising photoconductive insulating particles dispersed in a homogeneous photoconductive insulating matrix. The photoconductor is in the form of a particulate photoconductive inorganic crystalline pigment broadly disclosed as being present in an amount from about 5 to 80 percent by weight. Photodischarge is said to be caused by the combination of charge carriers generated in the photoconductive insulating matrix material and charge carriers injected from the photoconductive crystalline pigment into the photoconductive insulating matrix.

U.S. Pat. No. 3,037,861 to Hoegl et al. teaches that polyvinyl carbazole exhibits some long-wave U. V. sensitivity and suggests that its spectral sensitivity be extended into the visible spectrum by the addition of dye sensitizers. Hoegl et al. further suggests that other additives such as zinc oxide or titanium dioxide may also be used in conjunction with polyvinyl carbazole. In Hoegl et al., it is clear that the polyvinyl carbazole is intended to be used as a photoconductor, with or without additive materials which extend its spectral sensitivity.

In addition to the above, certain specialized layered structures particularly designed for reflex imaging have been proposed. For example, U.S. Pat. No. 3,165,405 to Hoesterey utilizes a two layered zinc oxide binder structure for reflex imaging. The Hoesterey patent utilizes two separate contiguous photoconductive layers having different spectral sensitivities in order to carry out a particular reflex imaging sequence. The Hoesterey device utilizes the properties of multiple photoconductive layers in order to obtain the combined advantages of the separate photoresponse of the respective photoconductive layers.

It can be seen from a review of the conventional composite photoconductive layers cited above, that upon exposure to light, photoconductivity in the layered structure is accomplished by charge transport through the bulk of the photoconductive layer, as in the case of vitreous selenium (and other homogeneous layered modifications). In devices employing photoconductive binder structures, which include inactive electrically insulating resins such as those described in the Middleton et al., U.S. Pat. No. 3,121,006, conductivity or charge transport is accomplished through high loadings of the photoconductive pigment allowing particle-to-particle contact of the photoconductive particles. In the case of photoconductive particles dispersed in a photoconductive matrix, such as illustrated by the Middleton et al., U.S. Pat. No. 3,121,007, photoconductivity occurs through the generation of charge carriers in both the photoconductive matrix and the photoconductor pigment particles.

Although the above patents rely upon distinct mechanisms of discharge throughout the photoconductive layer, they generally suffer from common deficiencies, in that the photoconductive surface during operation is exposed to the surrounding environment, and particularly in the case of cycling xerography, susceptible to abrasion, chemical attack, heat, and multiple exposures to light during cycling. These effects are characterized by a gradual deterioration in the electrical characteristics of the photoconductive layer resulting in the printing out of surface defects and scratches, localized areas of persistent conductivity which fail to retain an electrostatic charge, and high dark discharge.

In addition to the problems noted above, these photoconductive layers require that the photoconductor comprise either a hundred percent of the layer, as in the case of the vitreous selenium layer, or that they preferably contain a high proportion of photoconductive material in the binder configuration. The requirements of a photoconductive layer containing all or a major proportion of a photoconductive material further restricts the physical characteristics of the final plate, drum or belt in that the physical characteristics such as flexibility and adhesion of the photoconductor to a supporting substrate are primarily dictated by the physical properties of the photoconductor, and not by the resin or matrix material which is preferably present in a minor amount.

Another form of composite photosensitive layer which has also been considered by the prior art includes a layer of photoconductive material which is covered with a relatively thick plastic layer and coated on a supporting substrate. U.S. Pat. No. 3,041,166 to Bardeen describes such a configuration in which a transparent plastic material overlays a layer of vitreous selenium which is contained on a supporting substrate. The plastic material is described as one having a long range for charge carriers of the desired polarity. In operation, the free surface of the transparent plastic is electrostatically charged to a given polarity. The device is then exposed to activating radiation which generates a hole-electron pair in the photoconductive layer. The electron moves through the plastic layer and neutralizes a positive charge on the free surface of the plastic layer thereby creating an electrostatic image. Bardeen, however, does not teach any specific plastic materials which will function in this manner, and confines his examples to structures which use a photoconductor material for the top layer.

French Pat. No. 1,577,855 to Herrick et al. describes a special purpose composite photosensitive device adapted for reflex exposure by polarized light. One embodiment which employs a layer of dichroic organic photoconductive particles arrayed in oriented fashion on a supporting substrate and a layer of polyvinyl carbazole formed over the oriented layer of dichroic material. When charged and exposed to light polarized perpendicularly to the orientation of the dichroic layer, the oriented dichroic layer and polyvinyl carbazole layer are both substantially transparent to the initial exposure light. When the polarized light hits the white background of the document being copied, the light is depolarized, reflected back through the device and absorbed by the dichroic photoconductive material. In another embodiment, the dichroic photoconductor is dispersed in oriented fashion throughout the layer of polyvinyl carbazole.

In copending U.S. applications Ser. Nos. 94,139, 93,994, 94,071 and 93,975, all filed on Dec. 1, 1971, photosensitive members having two functional materials are described. The first material is a photoconductor which is capable of photogenerating and injecting photo-excited holes and electrons into a contiguous adjacent electronically active material. The electronically active material comprises a transparent organic material which is substantially non-absorbing to electromagnetic radiation in the region of intended xerographic use, but which is electronically active in that it allows the injection of photo-excited holes or electrons from the photoconductor and further allows these photogenerated charges to be transported through the active material to selectively dissipate a surface charge.

The use of electronically active materials in combination with photoconductors in xerographic photoreceptors, as disclosed in the aforementioned copending applications, is of enormous importance in xerography. For example, this type of photoreceptor can contain as little at 0.1% by volume of photoconductor to electronically active organic material thereby rendering them economical. In addition, these photoreceptors provide outstanding physical strength and flexibility which enable their use under rapid recycling conditions required in present xerographic processes.

Therefore it can readily be seen that there is a continuing need to develop xerographic photoreceptors having the requisite electrical and physical properties for conditions of rapid recycling. In addition, the need for photoreceptors containing novel compositions of electronically active organic materials and photoconductors is readily appreciated.

OBJECTS OF THE INVENTION

It is therefore, an object of this invention to provide a novel photosensitive device adapted for cyclic imaging.

It is a further object of this invention to provide a novel imaging system.

It is a further object of this invention to provide photosensitive members and a process for obtaining them, which exhibit efficient hole photogeneration and transport.

It is another object of this invention to provide novel photosensitive devices.

It is a further object of this invention to provide a novel method of imaging photosensitive devices.

It is yet another object of this invention to provide novel photosensitive devices which are capable of exhibiting outstanding mechanical properties.

SUMMARY OF THE INVENTION

The foregoing objects and other are accomplished in accordance with this invention by providing a photosensitive member having at least two functional materials. The first material comprises a photoconductive substance which is capable of photogenerating and injecting photo-excited holes into a contiguous or adjacent electronically active material. The electronically active material comprises a transparent organic polymer or nonpolymer material which is substantially non-absorbing to visible light or radiation in the region of intended use, but which is active in that it allows the injection of photo-excited holes from the photoconductive layer and allows these holes to be transported through the active layer to selectively discharge a surface charge on the free surface of the active layer. The particular organic electronically active materials contemplated for use in the present invention include phenyl substituted polycyclic compounds inclusive of materials such as a 2-phenylnaphthalene, 2-phenylanthracene, 2-phenylindole, 3-phenylindole, 1-phenylpyrene, 2-phenylpyrene and corresponding polymers thereof. Representative chemical configurations for suitable monomeric units include, for instance, the following:

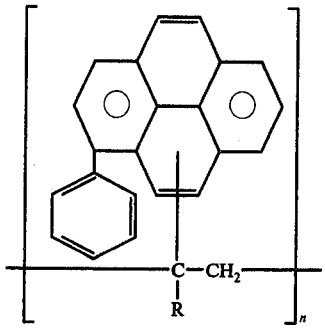

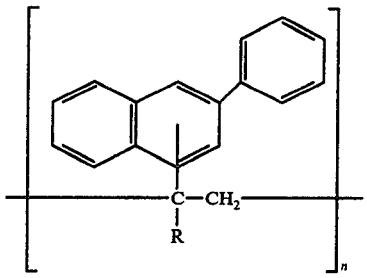

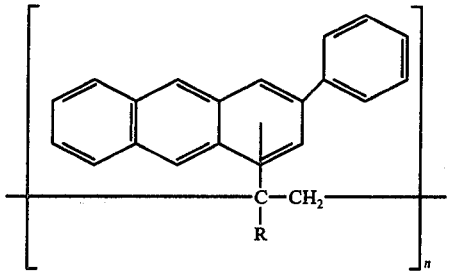

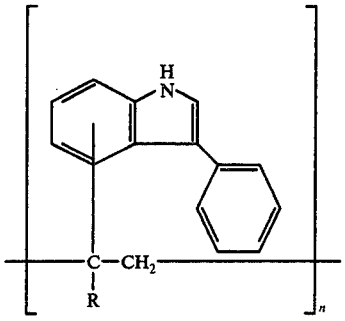

wherein R is defined, for instance, as an alkyl group such as an alkyl of 1–15 carbon atoms and preferably lower alkyl of 1–4 carbons such as methyl which in turn, usefully include reactive sites for grafting indicated, for instance, by the presence of a hydroxyl substituent; R is also defined as an aryl group such as phenyl group, inclusive of phenyl, alkylphenyl, halophenyl, hydroxylphenyl and cyanophenyl; and *n* is conveniently defined as a positive number ranging from about 5–5000 or higher with a polymer weight up to about 1 million or higher.

In a broader aspect the instant invention includes a class of compounds having phenyl-substituted aromatic or heterocyclic groups with at least two fused ring nuclei, where the position of the phenyl substituent group is determined by assuming the elimination of a privotal ring from an aromatic or heterocyclic radical having one more ring than that of the substituted compound.

It is to be understood that the use of the instant electronically active substances allows a variety of photoreceptor structures. Therefore, the electronically active substances may be in combination with photoconductive material in the form of a binder structure or a layered configuration.

It is to be further understood that the active materials of the present invention do not function as photoconductors in the wavelength region of xerographic use. As stated above, hole-electron pairs are photogenerated in the photoconductive material and the holes are then injected into the contiguous or adjacent electronically active material and hole transport occurs through the active material.

A typical application of the instant invention includes the use of a sandwich cell or layered configuration which in one embodiment consists of a supporting substrate such as a conductor containing a photoconductive layer thereon. For example, the photoconductive layer may be in the form of a layer of amorphous or vitreous selenium. A transparent layer such as 2-phenylindole, which allows for hole injection and transport, is coated over the selenium photoconductive layer. The use of the transparent electronically active layer of 2-phenylindole permits placing a photoconductive layer adjacent to a support substrate, and protecting the layer with a top surface which will allow for the transport of photoexcited holes from the photoconductor, while also physically protecting the photoconductive layer from environmental conditions. This structure can then be imaged in the conventional xerographic manner, which usually includes charging, optical projection exposure, and development.

In general, the advantages of the improved structure and method of imaging will become apparent upon consideration of the following disclosure of the invention; especially when taken in conjunction with the accompanying drawings wherein:

DETAILED DESCRIPTION OF THE DRAWINGS

Figure 2:
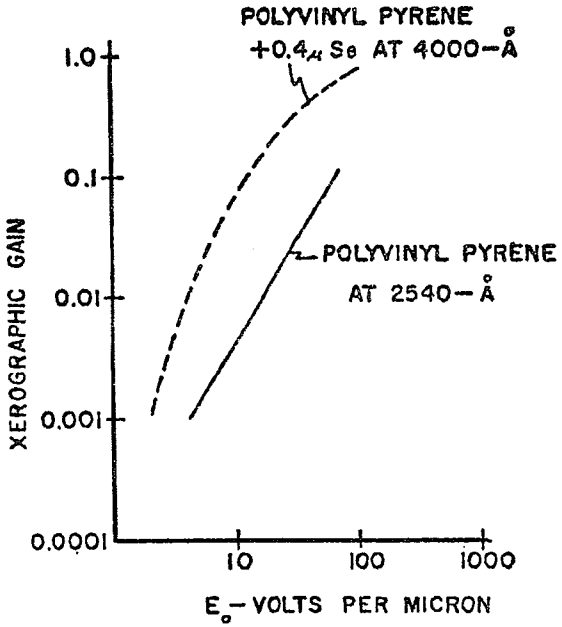
FIG. 2 is a plot similar to FIG. 1 for a second active material.

As defined herein, a photoconductor is a material which is electrically photoresponsive to light in the wavelength region in which it is to be used. More specifically, it is a material whose electrical conductivity increases significantly in response to the absorption of electromagnetic radiation in a wavelength region in which it is to be used. This definition is necessitated by the fact that a vast number of aromatic organic compounds are known or expected to be photoconductive when irradiated with strongly absorbed ultraviolet, x-ray, or gamma-radiation. Photoconductivity in organic materials is a common phenomenon. Practically all highly conjugated organic compounds exhibit some degree of photoconductivity under appropriate conditions. Most of these organic materials have their prime wavelength response in the ultraviolet responsive materials, and their short wavelength response is not particularly suitable for document copying or color reproduction. In view of the general prevalence of photoconductivity in organic compounds following short wavelength excitation, it is therefore necessary that for the instant invention, the term "photoconductor" or "photoconductive" be understood to include only those materials which are in fact photoresponsive in the wavelength region in which they are to be used.

Electronically active material, as described in the present invention, which is also referred to as the active matrix material when used as a matrix for a binder layer, is a substantially non-photoconductive material which supports an injection efficiency of photo-excited holes from the photoconductive layer of at least about 10 percent at fields of about $2 \times 10^5$ volts/cm. This material is further characterized by the ability to transport the carrier at least $10^{-3}$ cm. at a field of no more than about $10^6$ volts/cm. In addition, the active material is transparent in the wavelength region in which the device is to be used.

The active transport materials which are employed in conjunction with photoconductors in the instant invention are materials which are insulators to the extent that an electrostatic charge placed on said active transport materials is not conducted in the absence of illumination, at a rate sufficient to prevent the formation and retention of an electrostatic latent image thereon. In general, this means that the specific resistivity of the active transport material should be at least about $10^{10}$ ohm-cms.

As can be seen from the above discussion, the particular materials which are useful for the active transport systems of the instant invention are incidentally also photoconductive when radiation of wavelengths suitable for electronic excitation is absorbed by them. However, photoresponse in the short wavelength region, which falls outside the spectral region for which the photoconductor is to be used, is irrelevant to the performance of the device. It is well known that radiation must be absorbed in order to excite photoconductive response, and the transparency criteria stated above for the active materials implies that these materials do not contribute significantly to the photoresponse of the photoreceptor in the wavelength region of use.

Figure 1:
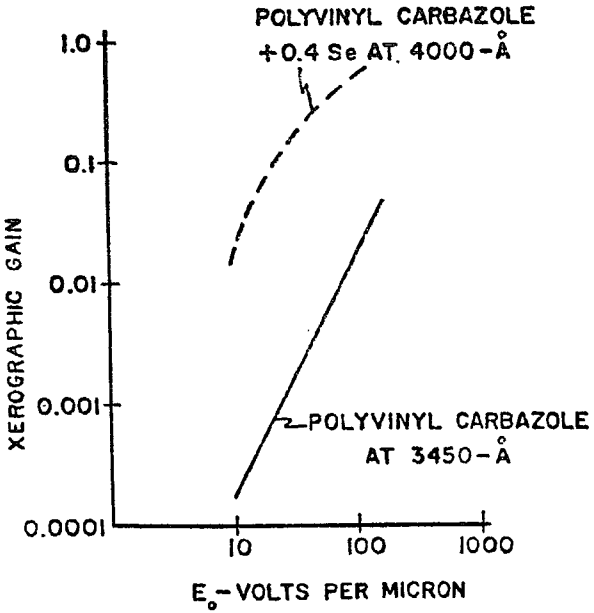
FIG. 1 illustrates a plot of photosensitivity versus field dependence for an electronically active material alone, and in conjunction with a photoconductor.

The reason for the requirement that the active transport materials must be transparent is based upon the discovery that under all practical conditions, the efficiency of photoinjection from the photoconductor into the active materials, for visible radiation absorbed by the photoconductor, far exceeds the intrisic photosensitivity of the active material in any wavelength region — visible or otherwise. The situation is illustrated by FIGS. 1 and 2 which show a comparison of the field dependence of the injection sensitivity of the photoconductor selenium into and the intrinsic photosensitivity of, two electronically active materials disclosed in copending applications Ser. Nos. 93,994 and 94,139 corresponding to Belgian Pat. Nos. 763,541 and 763,540, polyvinyl carbazole (PVK and polyvinyl pyrene (PVP), each measured on samples 20 microns thick contained on an aluminum substrate and prepared by the methods outlined in above-mentioned copending applications. The curves for the layered structures of the same materials having a 0.5 micron layer of vitreous selenium formed between the layer of active material and substrate are similar to the structure illustrated by FIG. 2. The data of FIGS. 1 and 2 is determined by plotting the initial xerographic gain ($g$) as a function of the applied field. The xerographic gain was calculated from the initial discharge rate $$G = \frac{\left(\frac{dV}{dt}\right) tro}{\left(\frac{eId}{\Sigma}\right)}$$

where $I$ is the incident photon flux, $d$ the thickness of the layer, $\epsilon$ the electric permittivity, and $e$ the electronic charge. A xerographic gain of unity would be observed if one charge carrier per incident photon were excited and moved across the layer. It is clear from FIGS. 1 and 2 that the intrinsic photoconductivity of the active materials at their peak wavelength of absorption (U. V. excitation) leads to gains considerably lower than the two phase structure incorporating efficient photoconductive materials, such as illustrated by the layered structures employing the thin selenium layers with suitable active materials, which can achieve gains of approximately 0.70 at a field of about 10 volts/cm., using an excitation wavelength within the visible spectrum (4000–8000 A).

Figure 3:
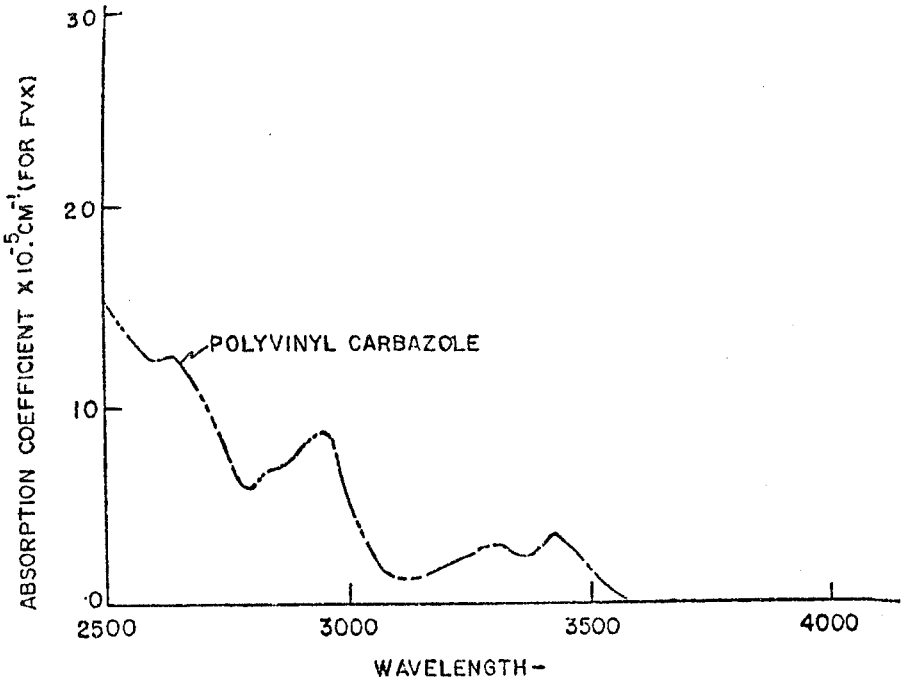
FIG. 3 represents a plot of the absorption spectrum for polyvinyl carbazole.
Figure 4:
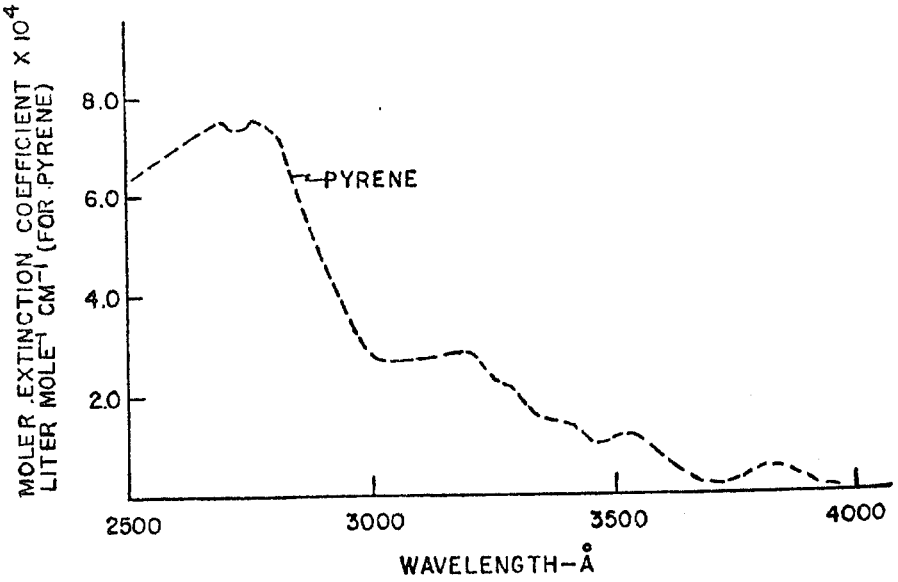
FIG. 4 represents a plot of the absorption spectrum for pyrene.

FIGS. 3 and 4 are absorption spectra for PVK and PVP at wavelengths of from 2500 A to 4000 A. It is clear from these spectra that PVK and PVP will exhibit negligible, if any, discharge when exposed to a wavelength of light useful in xerography i.e., 4000–8000 A. The obvious improvement in performance which results from the use of the two phase systems of this nature can best be realized if the active material is substantially transparent to radiation in a region in which the photoconductor is to be used; for any absorption of desired radiation by the active material will prevent this radiation from reaching the photoconductive material where it is much more effectively utilized. It therefore follows that it is advantageous to use electronically active materials which are transparent in the wavelength in which the photoconductor has its main response, and more particularly in the wavelength region in which the photoconductor is to be used. The electronically active materials of the instant invention also demonstrate transparency and non-absorbency in the wavelength region of from 4000 to 8000 A.

Figure 5:
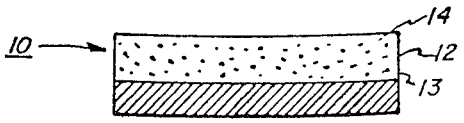
FIG. 5 is a schematic illustration of one embodiment of a device of the instant invention.

Referring to FIG. 5, reference character 11 illustrates a preferred embodiment of the instant invention which comprises a photosensitive member in the form of a plate having a supporting substrate 11 coated with a binder layer 12. Substrate 11 preferably comprises any suitable conductive material. Typical conductors comprise aluminum, steel, brass, or the like. The substrate may be rigid or flexible and of any convenient thickness. Typical substrates include flexible belts or sleeves, sheets, webs, plates, cylinders, and drums. The substrate or support may also comprise a composite structure such as a thin conductive coating contained on a paper base; a plastic coated with a thin conductive layer such as aluminum or copper iodide; or glass coated with a thin conductive coating of chromium or tin oxide. When using a transparent substrate it should be understood that imagewise exposure may optionally be carried out through the substrate or back of the imaging member.

Binder layer 12 contains photoconductive particles 13 dispersed in a unoriented fashion in an electronically active matrix or binder material 14. The photoconductive particles may consist of any suitable inorganic or organic photoconductor, and mixtures thereof, which are capable of injecting photo-excited holes into the matrix. Typical inorganic materials include inorganic crystalline compounds and inorganic photoconductive glasses. Typical inorganic crystalline compounds include cadmium sulfoselenide, cadmium selenide, cadmium sulfide, and mixtures thereof. Inorganic photoconductive glasses include amorphous selenium, and selenium alloys such as selenium-tellurium and selenium-arsenic. Selenium may also be used as a crystalline form known as trigonal selenium. Typical organic photoconductive materials include phthalocyanine pigments such as the X-form of metal free phthalocyanine described in U.S. Pat. No. 3,357,989 to Bryne et al., metal phthalocyanines, such as copper phthalocyanine; quinacridones available from DuPont under the Tradename Monastral Red, Monastral Violet, and Monastral Red Y; substituted 2,4-diamino-triazines disclosed by Weinberger in U.S. Pat. No. 3,445,227; triphenodioxazine disclosed by Weinberger in U.S. Pat. No. 3,442,781; polynuclear aromatic quinones available from Allied Chemical Corp. under the Tradename Indofast Double Scarlet, Indofast Violet Lake B, Indofast Brilliant Scarlet, and Indofast Orange. The above list of photoconductors should in no way be taken as limiting, but is merely illustrative of suitable materials. The size of photoconductive particles is not critical, but particles in a size range of about 0.01 to 1.0 microns yield particularly satisfactory results.

As previously stated, the photoconductive material of the instant invention is employed in an unoriented manner. By unoriented, it is meant that the pigment or photoconductive material is isotropic with respect to the exciting electromagnetic radiation in that it is equally sensitive to any polarization of the exciting radiation.

The electronically active matrix material 14 comprises the phenyl substituted aromatic or heterocyclic organic materials described above and exemplified by 2-phenylnaphthalene, 2-phenylanthracene, 4-phenylpyrene and 2-phenylindole which materials support the injection of photoexcited holes from the photoconductive pigment and allow the transport of these holes through the active matrix material to selectively discharge a surface charge. In addition, corresponding condensation, addition and other types of polymers of monomers corresponding to 2-phenylnaphthalene, 2-phenylanthracene, 4-pyrene and 2-phenylindoles are electronically active and fall within the purview of the present invention.

As pointed out above, the use of any polymer (a polymer being a large molecule built up by the repetition of small simple chemical units) whose repeat unit contains the appropriate electronically active organic monomer of the present invention, i.e., 2-phenylindole, may be used within the context of the present invention. It is therefore not the intent of the invention to restrict the type of polymer which can be employed as the matrix material. Polyesters, polysiloxanes, polyamides, polyurethanes and epoxides as well as block, random or graft copolymers (containing the aromatic repeat unit) are exemplary of the various types of polymers which can be employed. In addition suitable mixtures of active polymers with inactive polymers or nonpolymeric materials may also be employed.

A very useful way of obtaining compounds within the scope of the present invention involves conversion of a suitable polycyclic molecule with an organic acid such as acetic acid or the anhydride in the presence of zinc chloride to obtain an acetyl derivative. The derivative is then converted to the corresponding vinyl intermediate by contacting with trimethyl phosphonium bromide and a base such as n-butyllithium, and thereafter polymerizing, preferably as a homopolymer or in admixture with up to about 40% by weight of other monomers, at a controlled temperature ranging from about 75° up to about 0° C, in a suitable organic reaction solvent such as ethyl ether, methylene chloride or tetrahydrofuran in the presence of a catalytic amount of a Lewis acid (i.e. about 100–500 ppm), and particularly $BF_3$, $AlCl_3$, $SbCl_3$, $BiCl_3$ and triphenyl chloromethane. The synthesis is exemplified in the following equation:

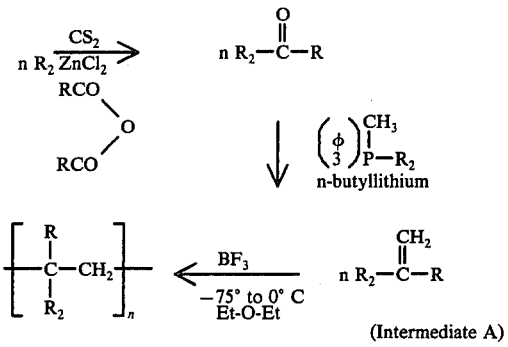

(Intermediate A)

in which $R_2$ is a polycyclic group such as an aryl of at least 2 fused rings or a heterocyclic group such as a naphthalene, a carbazole, an anthracene, an indole, or a pyrene group; the phenyl derivatives defined as $R_2$ on pages 9 and 30–31 being non-exclusively included within this definition for synthesis purposes; and R and *n* are defined as above. Suitable low weight organic aliphatic acids such as acetic acid or butyric acid can be conveniently used as reaction solvents in place of $CS_2$ as desired.

Another useful synthesis for obtaining Intermediate A (supra) requires reacting a corresponding aldehyde of $R_2$, in accordance with the process described by Vollman J.L., Annalen. Der Chemie; 534, 1 (1937) by the Wittig reaction to obtain the corresponding vinyl derivative, which is then conveniently polymerized, as indicated, to obtain a polymer.

When the copolymer is desired, a controlled admixture with up to about 90% by weight of a monomer composed of a polycyclic aromatic molecule or up to about 10% by weight of an alkylvinyl ether butadiene or other aliphatic vinyl monomer can be conveniently reacted at a slightly higher temperature varying from about −10° to about 0° C in the presence of a reaction solvent and a catalyst of the type indicated above.

In general, the active photoconductive layer is substantially transparent or non-absorbing in at least some significant portion of the range from about 4000–8000 Angstroms, but will still function to allow injection and transport of holes generated within this wavelength range by the photoconductive pigment particles.

An upper limit on photoconductor volume concentration or occupancy is governed by various factors: Notably (1) the stage at which the physical properties of the polymer are seriously impaired; (2) the stage at which there is significant transport through particle-to-particle contacts; and (3) the stage at which, with conductive pigments such as trigonal selenium, there is excessive hole sweep out during charging. The latter two factors frequently lead to a lack of cycling ability. In general, to attain the best combination of physical and electrical properties the upper limit for the photoconductive pigment or particles must be no greater than about 5 percent by volume of the binder layer. A lower limit for the photoconductive particles of about 0.1 percent by volume of the binder layer is required to insure that the light absorption coefficient is sufficient to give appreciable carrier generation. In order to achieve a closely equivalent discharge rate under both charging conditions, it is necessary to work in a volume occupancy region where the average depth of light penetration is near the center of the layer.

A full explanation of the charge characteristics of an active binder plate with respect to volume concentration is disclosed in copending U.S. Application, Ser. No. 93,994 (Belgian Pat. No. 763,541) the contents of which is hereby incorporated by reference.

As disclosed in Ser. No. 93,994 a critical range of about 0.1 to 5 percent by volume of the photoconductor is required to achieve the advantages of the electronically active matrix binder compositions of the instant invention.

The thickness of the binder layer is not particularly critical. Layer thicknesses from about 2 to 100 microns have been found satisfactory, with a preferred thickness of about 5 to 50 yielding particularly good results.

Figure 6:
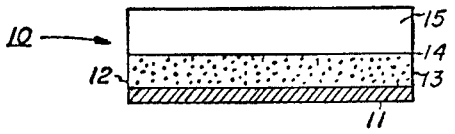
FIG. 6 illustrates a second embodiment of a device for the instant invention.

Referring to FIG. 6 reference character 10 designates an imaging member in the form of a plate which comprises a supporting substrate 11 having a binder layer 12 thereon, and an active layer 15 positioned over binder layer 12. Substrate 11 is preferably made up of any suitable conductive material such as those outlined for the substrate of FIG. 5.

Binder layer 12 contains photoconductive particles 13 dispersed randomly without orientation in a binder 14. The photoconductive particles may consist of any suitable inorganic or organic photoconductor and mixtures thereof. Suitable photoconductive materials include those defined above for the structure of FIG. 6.

The binder material 14 may comprise any electrically insulating resin such as those disclosed in the above mentioned Middleton et al. U.S. Pat. No. 3,121,006 or any suitable active material which may be the same or different from that used for layer 15. When using an electronically inactive or insulating resin it is essential that there be particle-to-particle contact between the photoconductive particles. This necessitates that the photoconductive material be present in an amount of at least about 25 percent by volume of the binder layer with no limitation on the maximum amount of photoconductor in the binder layer. If the matrix or binder comprises an electronically active material, the photoconductive material need only comprise about 1 percent or less by volume of the binder layer with no limitation on the maximum amount of photoconductor in the binder layer. The thickness of the photoconductive layer is not critical. Layer thickness from about 0.05 to 20 microns have been found satisfactory, with a preferred thickness of about 0.2 to 5 microns yielding good results.

Electronically active layer 15 comprises the electronically active materials defined above (i.e. a-phenylnaphthalene, 2-phenylanthracene, a-phenylindole, a-phenyl pyrene or polymers thereof). These materials are capable of supporting the injection of photo-excited holes from the photoconductive layer and allowing the transport of these holes through the organic layer to selectively discharge a surface charge.

The active layer not only serves to transport holes, but also protects the photoconductive layer for abrasive or chemical attack and therefore extends the operating life of the photoreceptor imaging member.

In general, the thickness of the electronically active layer should be from about 5 to 100 microns, but thicknesses outside this range can also be used. The ratio of the thickness of the active layer to the photoconductor layer should be maintained from about 2:1 to 200:1.

Figure 7:
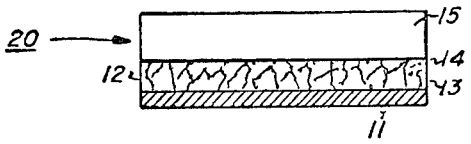
FIG. 7 illustrates a third embodiment of a device of the instant invention.

In another embodiment of the instant invention, the structure of FIG. 6 is modified to insure that the photoconductive particles are in the form of continuous chains through the thickness of binder layer 12. This embodiment is illustrated by FIG. 7 in which the basic structure and materials are the same as those of FIG. 6, except that the photoconductive particles 13 are in the form of continuous chains.

Figure 8:
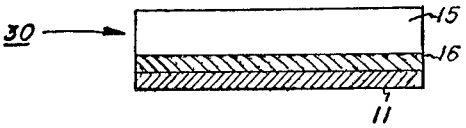
FIG. 8 illustrates a fourth embodiments of a device of the instant invention.

Alternately, the photoconductive layer may consist entirely of the substantially homogeneous unoriented photoconductive material such as a layer of amorphous selenium or selenium alloy, or a powdered or sintered photoconductive layer such as cadmium sulfoselenide or phthalocyanine. This modification is illustrated by FIG. 8 in which a photosensitive member 30 comprises a substrate 11, having a homogeneous photoconductive layer 16, with an overlaying active organic layer 15.

Another modification of the binder and layered configurations described in FIGS. 5, 6, 7, and 8 includes the use of a blocking layer 17 at the substrate-photoconductor interface. This configuration is illustrated by photosensitive member 40 in FIG. 9 in which the substrate 11, and photoconductive layer 16 are separated by a blocking layer 17. The blocking layer functions to prevent the injection of charge carriers from the substrate into the photoconductive layer. Any suitable blocking material may be used. Typical materials include nylon, epoxy, and aluminum oxide.

As stated above, the photoconductor material, whether it be in the form of a pigment or as a homogeneous layer, is employed in an unoriented manner. By unoriented, it is meant that the pigment or photoconductive layer is isotropic with respect to the exciting electromagnetic radiation, i.e., it is equally sensitive to any polarization of the exciting radiation.

In general, the binder and layered structures of the instant invention require that the photoconductor be selected or matched with the electronically active materials of the present disclosure so that charges will be photogenerated by radiation to which the active materials are transparent or non-absorbing. This area corresponds to a wavelength region of from about 4000–8000 Angstrom Units which is the preferred range for xerographic utility. In addition, the photoconductor should be responsive to all wavelengths from 4000 to 8000 Angstrom Units if panchromatic response is required. All photoconductor-active material combinations of the instant invention result in the injection and subsequent transport of holes across the physical interface between the photoconductor and active material.

DESCRIPTION OF THE PREFERRED EMBODIMENTS

The following examples further specifically define the present invention with respect to a method of making a photosensitive member containing a photoconductive layer contiguous to a layer of the electronically active material of the present invention. The percentages are by weight unless otherwise indicated. The examples below are intended to illustrate various preferred embodiments of the instant invention.

Example I

Figure 9:
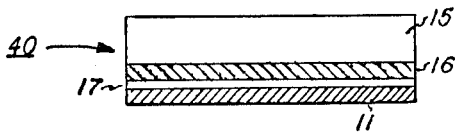
FIG. 9 illustrates a fifth embodiment of a device of the instant invention.

A plate or layered structure similar to that illustrated in FIG. 9 consisting of a 20 micron layer of 2-phenylindole, coated on top of a 1 micron layer of amorphous selenium deposited on 2 × 2 inch NESA glass substrate is prepared as follows:

(1) A polyvinyl carbazole blocking layer 0.2 microns thick is formed on one surface of the NESA substrate by dip coating the substrate in a 1 percent solution of polyvinyl carbazole in toluene. After coating, the substrate is air dried at 100° C for 16 hours.

(2) A vitreous selenium photoconductor layer is applied over the blocking layer by vacuum deposition techniques such as those disclosed by Bixby in U.S. Pat. Nos. 2,753,278 and 2,970,906. The selenium layer is formed in a thickness of about 1 micron. During deposition, the substrate temperature is maintained at about 25° to 55° C. The selenium source is maintained at 260° C and evaporation carried out at a pressure of $1 \times 10^{-6}$ Torr.

(3) The layered plate is then placed in a second vacuum chamber and 1 gram of 2-phenylindole placed in the evaporation crucible. The organic material is then vacuum evaporate at a pressure of $5 \times 10^{-6}$ Torr onto the selenium layer in 30 minutes at a source temperature of about 50° C while maintaining the substrate at a temperature of about 10° C. This results in a 2-phenylindole layer thickness of about 20 microns. The resulting layered plate is allowed to cool in a vacuum at room temperature for 24 hours.

Example II

A layered structure similar to that of Example I comprising a 35 micron layer of 2-phenylnaphthalene, coated on a 0.5 layer of selenium deposited on a NESA glass substrate is prepared by the vacuum evaporation processes outline in Example I. In forming the 2-phenylnaphthalene layer the pressure is $6 \times 10^{-6}$ Torr, and deposition carried out for 150 minutes at a source temperature of 50° C and substrate temperature of 0° C.

The discharge characteristics of the electronically active plates prepared in Examples I and II are measured. Specifically, the layered structures were corona charged to a selective negative potential, $V_o$, and exposed to a monochromatic light source of 4000 A at a flux of $2 \times 10^{12}$ photons/cm$^2$ - sec. At this wavelength the electronically active materials of the present invention are substantially non-absorbing and the selenium is photoresponsive. The initial discharge rate $(dV/dT)$ $T=0$ of each plate at the selected potential was measured according to the techniques outlined by P. Regensburger in "Optical Sensitization of Charge Carrier Transport in PVK", *Photochemistry and Photobiology* 8, p. 429–40 (November, 1968), hereby incorporated by reference.

Figure 10:
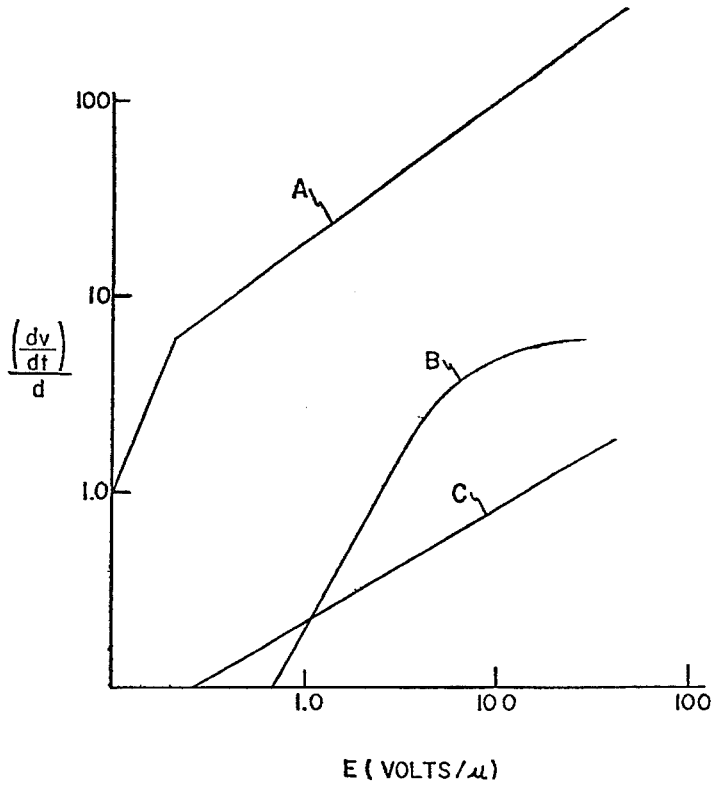
FIG. 10 illustrates the discharge characteristics of the instant electronically active materials.

A number of initial discharge rates at selected potentials for each plate are measured, divided by the thickness of the electronically active organic layer and plotted on a logarithm scale against the corresponding applied field, E, as shown in FIG. 10. This type of graph indicates the field dependence of charge mobility through the respective electronically active organic layer. Curve A represents the charge mobility of photogenerated holes through selenium. The ideal electronically active material in combination with selenium would closely approximate the field dependence curve, A, for selenium.

As can -phenylnaphthalene seen from FIG. 12, curve B, the selenium-2-phenynaphthalene layered plate has adequate discharge at applied fields above about 1 volt/micron. In addition, the curve indicates that the 2-phenylnaphthalene transport holes adequately enough to result in acceptable residual voltage after discharge compared to a pure selenium photoreceptor layer. Curve C, the selenium-2-phenylindole layered plate demonstrates an even lower threshold field at which charge mobility occurs and therefore a minimum of residual voltage will remain upon discharge.

While not to be construed as limiting the present invention, a theory is speculated to explain the electronically active properties of the instant materials. It has been established that pyrene, tetracene, 1,2-benzanthracene, and 3,4-benzocarbazole are electronically active and the important criteria for this is the extent of $\pi$-electron delocalization.

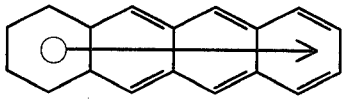

tetracene

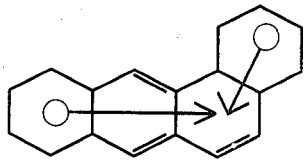

1,2-benzanthracene

The degree of electron delocalization is demonstrated by introduction of one bezenoid sextet in tetracene and two in 1, 2-benzanthracene (E. Clar, "Polyclicic Hydrocarbons", Acacemic Press, 1964, New York). Arrows are drawn to indicate the movement of the sextet among the rings of the compound. These sextets are composed of three mobile $\pi$-electron pairs, two of which are confined to the individual rings while the remaining pair is free to migrate throughout the system. As the ring system over which this third pair migrates becomes more extended the greater is the $\pi$-electron delocation. This is analogous to saying that the $\pi$-electrons are less shielded by the positive nuclear charge than in a less extended ring system, the limit being benzene.

In 1,2-benzanthracene there are two sextets, both being able to transmit one mobile pair of electrons to the pivotal ring of the angular system. This forms an induced sextet in the ring. The double bond at the 3,4-position is more or less formal as exhibited by the reaction at these positions. Spectra show that the delocalization takes place even when the —CH=CH— group is removed. That is 2-phenylnaphthalene has an electronic spectra similar to 1,2-benzanthracene. More specifically, it is believed that the p-orbitals of the phenyl group interact with those of the substituted molecule because of coplanarity of the rings. The electrons are able to delocalize about the whole plane of the molecule. Therefore comparing 2-phenylnaphthalene

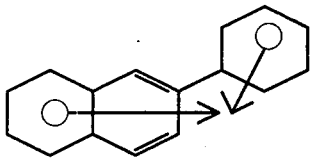

with benzanthracene, above, similar electron activity is predictable. The same is true for 1,2-benztetracene and 2-phenylanthracene.

A similar picture can be arrived at when considering carbazole. That is, a benzenoid ring at an angular position will increase the delocalization of the whole aromatic system. Consider the structures

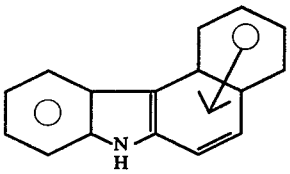

and 3,4 benzcarbazole

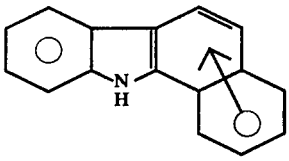

1,2 benzocarbazole

In both molecules the angular ring contributes $\pi$-electrons to the carbazole system. It might be expected that even if the 1, 2- or the 3,4-carbon atoms of the corresponding benzcarbazoles were eliminated this contribution would still exist.

Based on the above, the resultant compounds, 3-phenyl- and 2-phenylindole, respectively, will exhibit transport and injection superior to indole itself.

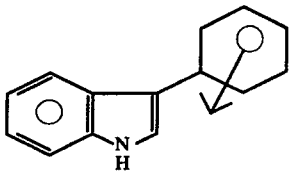

3-phenylindole

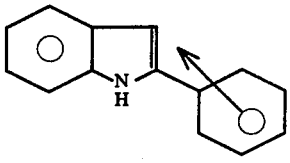

2-phenylindole

Two other compounds, the cases where the nitrogen of carbozole is replaced by oxygen or sulfur, that is, dibenzo [bd] furan and dibenzo [bd] thiophene, can be considered as active materials. The phenyl substituted compounds of interest are:

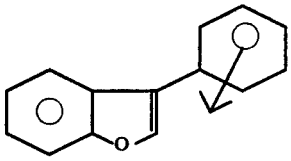

3-phenylbenzo [b] furan and

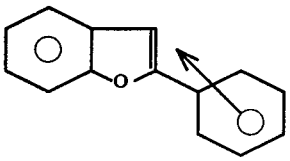

2-phenylbenzo [b] furan

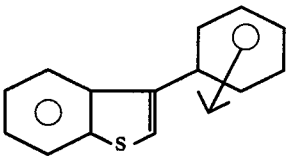

3-phenyl [b] thiophene

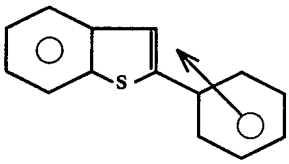

2-phenylbenzo [b] thiophene

Examples of other compounds which fit this requirement are shown below along with the present compound from which the phenyl substituted compound is derived.

| Parent Compound* | Derived Compound |
|---|---|
| 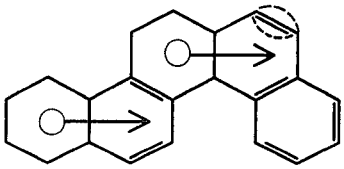 5,6-benzochrysene | 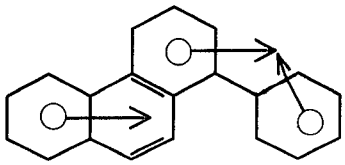 1-phenylphenantrene |
| 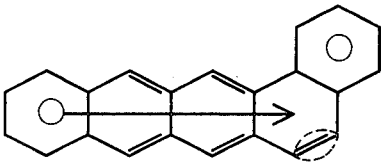 1,2-benzotetrance | 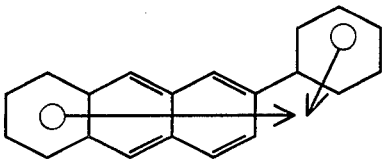 2-phenylanthracene |
| 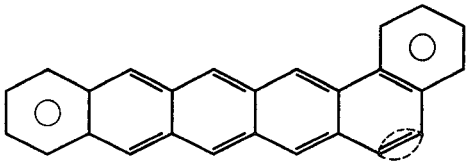 1,2-benzopentacene | 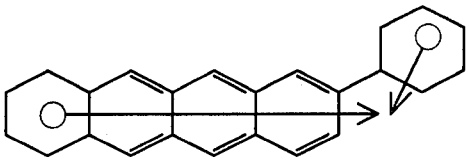 2-phenyltetracene |
| and | |
| 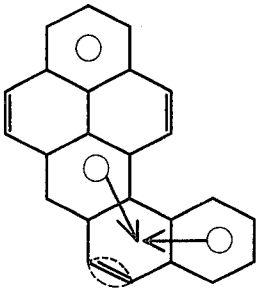 Naphtho-(1',2'-3,4)-pyrene | 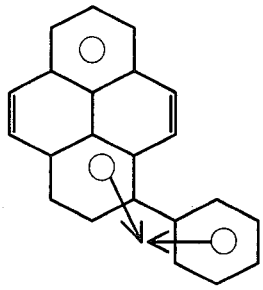 1-phenylpyrene |
| 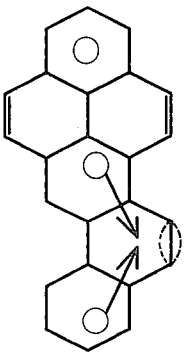 Naphtho(2',1'-3,4)-pyrene | 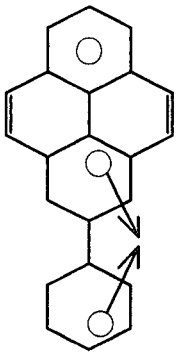 2-phenylpyrene |
| 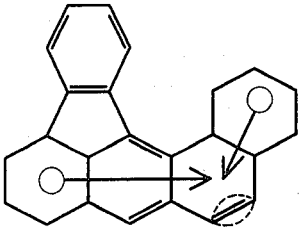 Naptho-1',2'-2,3)-fluoranthene | 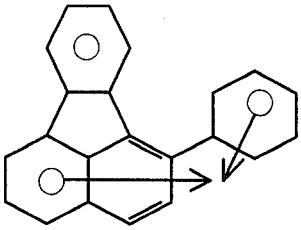 4-phenylfluoranthene |

-continued

| Parent Compound* | Derived Compound |
|---|---|
| 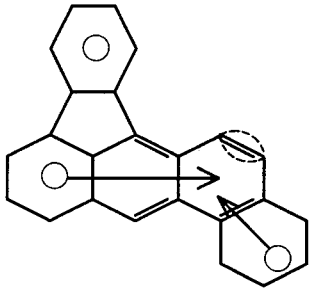 Naphtho-(2',1'-2,3)-fluoranthene | 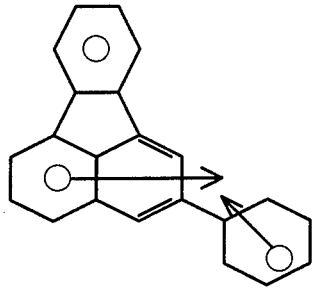 3-phenylfluoranthene |
| 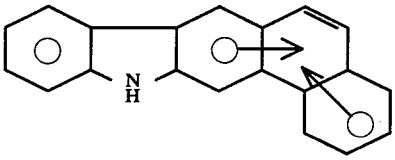 Naphtho-(1',2'-3,4)carbazole | 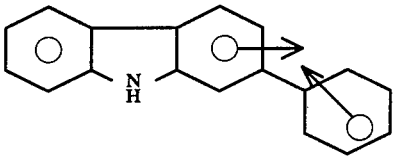 3-phenylcarbazole |
| 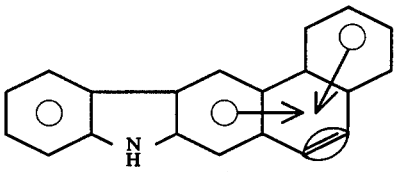 Naphtho-(2',1'-3,4)-carbazole | 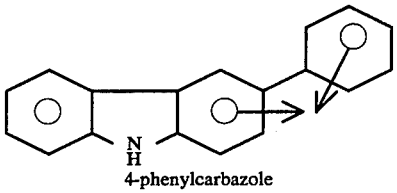 4-phenylcarbazole |

*The —CH=CH— group eliminated in each compound is encircled.

Also included with the scope of the instant invention are equivalent structures where N is replaced by S or O. The activity of these materials are dependent upon the aromatic structure of the molecule and therefore functional group substituents such as alkyl, amino, nitro, etc. which may facilitate the chemistry of preparation or alter to advantage the mechanical properties of polymers having these as repeat units, may be added to the phenyl aromatics with no loss of activity.

The class of compounds and polymers made using these as part of the repeat unit, can be described as follows. An aromatic system, including heterocyclics and those with functional group substituents, in which the $\pi$-electron delocalization is extended by phenyl substitution. The position of the phenyl group may be described as that formed on elimination of two carbons and the fixed double bond in the angle of the pivotal ring from the aromatic hydrocarbon which has one more ring than the substituted compound. For example, in 1,2-benzanthracene the elimination of the two carbons and fixed double bond, which exhibits reactivity equivalent to an olefin, result in the active molecule 2-phenylnapthalene.

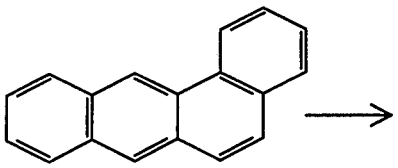

-continued

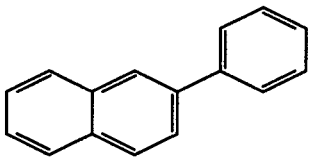

In brief, the present invention includes the class of compounds which include phenyl substituted aromatics where the position of the phenyl group is determined by eliminating the pivoted ring from the aromatic which has one more ring than the substituted compound.

Although specific components and proportions have been stated in the above description of the preferred embodiments of the instant invention, other suitable materials and procedures such as those listed above may be used with similar results. In addition, other materials and modifications may be utilized which synergize, enhance or otherwise modify the photosensitive member and method of use. For example, when using a transparent substrate such as a plastic coating with a thin conductive coating of aluminum or tin oxide, the structure may be imaged by exposure through the substrate. In addition, if desired, an electrically insulating substrate may also be used. In this instance, the charge may be placed upon the imaging member by double corona charging techniques well known and disclosed in the art. Other modifications using an insulating substrate or no substrate at all, include placing the imaging member onto a conductive backing member or platen and charging the surface while in contact with said backing member. Subsequent to imaging, the imaging member may then be stripped from the conductive backing.

Other modifications and ramifications of the present invention would appear to those skilled in the art upon reading the disclosure. These are also intended to be within the scope of the invention.

What is claimed is:

1. An imaging member comprising a layer of an inorganic crystalline compound or an inorganic photoconductive glass as photoconductive material and a contiguous layer of an electronically active organic material overlaying the photoconductive layer, said photoconductive layer exhibiting the capability of photo-excited hole generation and injection, the overlaying active organic material being transparent to the radiation absorbed by the photoconductive layer and capable of supporting the injection of photo-excited holes from the photoconductive layer and transporting said holes, wherein the overlaying active organic material is at least one material selected from the group consisting of a 3-phenylbenzo furan, 2-phenylbenzo-furan, 3-phenyl thiophene, 2-phenylbenzo thiophene, 1-phenylphenanthrene, 2-phenyltetracene, 1-phenylpyrene, 2-phenylpyrene, 4-phenylfluoranthene, 3-phenylfluoranthene, 3-phenylcarbazole, 4-phenylcarbazole, and corresponding polymers thereof, the ratio of thickness of the active organic material to the photoconductive layer being about 2:1 to 200:1.

2. The member of claim 1 in which the photoconductive layer comprises photoconductive particles dispersed in a binder.

3. The member of claim 1 in which the photoconductive layer comprises a substantially homogeneous photoconductive material.

4. The member of claim 1 in which the photoconductive layer is contained on a supporting substrate.

5. The member of claim 4 in which the substrate is electronically conductive.

6. The member of claim 5 in which the photoconductive layer is contained on a substantially transparent supporting substrate.

7. The member of claim 2 in which the photoconductive particles are present in an amount of about 0.1 to 1.0 percent by volume of the binder layer.

8. The member of claim 2 in which the binder layer is supported on a substrate.

9. The member of claim 8 in which the substrate is electrically conductive.

10. The member of claim 2 in which the binder layer is supported on a transparent substrate.

11. The member of claim 2 in which the photoconductive layer comprises at least one material selected from the group consisting of vitreous selenium, a selenium alloy, trigonal selenium, cadmium sulfoselenide, and the X-form of metal free phthalocyanine.

12. The member of claim 2 in which the active organic material is essentially a homopolymeric or copolymeric material comprising a substantial amount of monomeric units in random or block configuration represented by the formula

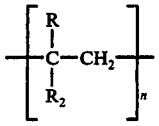

wherein

R is an alkyl group of 1–15 carbon atoms or a phenyl group;

$R_2$ is a member selected from the group consisting of a 2-phenylnaphthalene, 2-phenylanthracene, 3-phenylpyrene and 4-phenylpyrene; and

*n* is a positive number of about 5–500; wherein the molecular weight extends up to about one million or higher.

13. The imaging member of claim 2 wherein the photoconductive material is unoriented.

14. The member of claim 1 in which the photoconductive layer contains at least one of vitreous selenium, selenium alloy, trigonal selenium or cadmium sulfoselenide.

* * * * *